US008096770B2

(12) United States Patent
Liang

(10) Patent No.: US 8,096,770 B2
(45) Date of Patent: Jan. 17, 2012

(54) TRAILING EDGE COOLING FOR TURBINE BLADE AIRFOIL

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 515 days.

(21) Appl. No.: 12/396,629

(22) Filed: Mar. 3, 2009

(65) Prior Publication Data

US 2010/0074762 A1 Mar. 25, 2010

Related U.S. Application Data

(60) Provisional application No. 61/100,055, filed on Sep. 25, 2008.

(51) Int. Cl.
*F01D 5/18* (2006.01)

(52) U.S. Cl. ..... 416/97 R; 415/115

(58) Field of Classification Search ..... 416/97 R; 415/115

See application file for complete search history.

(56) References Cited

U.S. PATENT DOCUMENTS 4,297,077 A * 10/1981 Durgin et al. ..... 416/97 R
5,356,265 A * 10/1994 Kercher ..... 416/97 R
5,368,441 A 11/1994 Sylvestro et al.
5,702,232 A 12/1997 Moore
5,720,431 A 2/1998 Sellers et al.
5,752,801 A * 5/1998 Kennedy ..... 415/115
5,931,638 A 8/1999 Krause et al.
6,174,134 B1 * 1/2001 Lee et al. ..... 416/97 R
6,254,334 B1 7/2001 LaFleur
6,325,593 B1 12/2001 Darkins, Jr. et al.
6,347,923 B1 2/2002 Semmler et al.
6,402,470 B1 6/2002 Kvasnak et al.
6,607,356 B2 8/2003 Manning et al.
6,616,406 B2 9/2003 Liang
6,874,987 B2 4/2005 Slinger et al.
6,902,372 B2 6/2005 Liang
6,932,573 B2 8/2005 Liang
6,981,846 B2 1/2006 Liang
7,255,535 B2 * 8/2007 Albrecht et al. ..... 416/97 R
7,527,474 B1 * 5/2009 Liang ..... 416/1
7,549,844 B2 * 6/2009 Liang ..... 416/97 R
7,862,299 B1 * 1/2011 Liang ..... 416/97 R
7,980,821 B1 * 7/2011 Liang ..... 416/97 R
2006/0056967 A1 3/2006 Liang
2006/0222494 A1 10/2006 Liang
2009/0068021 A1 * 3/2009 Liang ..... 416/97 R
2009/0238695 A1 * 9/2009 Devore et al. ..... 416/97 R
2010/0226788 A1 * 9/2010 Liang ..... 416/97 R

* cited by examiner

*Primary Examiner* — Anh Mai

(57) ABSTRACT

A gas turbine engine hollow turbine airfoil having chordwise spaced apart leading and trailing edges, and widthwise spaced apart pressure and suction sidewalls extending chordwise between the leading edge and the trailing edge. A trailing edge rib extends from the trailing edge toward the leading edge, and forms a solid member between the pressure and suction sidewalls. A cooling fluid channel extends in the spanwise direction through the airfoil adjacent to the trailing edge rib. A plurality of fluid chambers are formed in the trailing edge rib. Film cooling holes extend from the fluid chambers to the pressure and suction sidewalls, and trailing edge discharge holes extend from the fluid chambers to the trailing edge. A metering hole is associated with each of the fluid chambers to define a flow restriction connecting the cooling fluid channel to a respective fluid chamber.

20 Claims, 3 Drawing Sheets

TRAILING EDGE COOLING FOR TURBINE BLADE AIRFOIL

CROSS-REFERENCE TO RELATED APPLICATION

This application claims the benefit of U.S. Provisional Application Ser. No. 61/100,055, entitled TRANSPIRATION COOLING FOR AIRFOIL TRAILING EDGE, filed Sep. 25, 2008, the entire disclosure of which is incorporated by reference herein.

FIELD OF THE INVENTION

This invention is directed generally to turbine blades and, more particularly, to a turbine blade airfoil having cooling fluid chambers for conducting a cooling fluid to cool a trailing edge of the airfoil.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products defining a working gas. The working gas is supplied to the turbine where the gas passes through a plurality of paired rows of stationary vanes and rotating blades. The rotating blades are coupled to a rotor and disc assembly. As the working gas expands through the turbine, the working gas causes the blades, and therefore the rotor and disc assembly, to rotate.

Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil ordinarily comprises a tip, leading edge and a trailing edge. Most blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Operation of a turbine engine results in high stresses being generated in numerous areas of a turbine blade. One particular area of high stress is found in the airfoil trailing edge, which is a portion of the airfoil forming a relatively thin edge that is generally orthogonal to the flow of gases past the blade and is on the downstream side of the airfoil. Because the trailing edge is relatively thin and an area prone to development of high stresses during operation, the trailing edge is highly susceptible to formation of cracks which may lead to failure of the airfoil.

A conventional cooling system in the airfoil of a turbine blade assembly may include cooling fluid passages to maximize convection cooling in the airfoil trailing edge, and discharge a substantial portion of the cooling air through the trailing edge of the airfoil. For example, a typical trailing edge cooling configuration comprises providing trailing edge cooling holes, which are conventionally of a constant diameter and are fed from a common cooling supply cavity, and which discharge at the centerline of the airfoil trailing edge or exit at an angle on the pressure side adjacent to the trailing edge. In the described arrangement, the cooling flow distribution into the trailing edge cooling holes and the pressure ratio across the cooling holes is predetermined by the cooing air pressure in the cooling supply cavity. The cooling air passing through the cooling holes is subsequently injected into the mainstream of hot gases, and may cause turbulence, coolant dilution and, in the case where pressure side bleed cooling is employed, there may be a loss of downstream film cooling effectiveness.

While many of the conventional airfoil cooling systems have operated successfully, a need still exists to provide increased cooling capability in the trailing edge portions of turbine blade airfoils while minimizing or reducing the flow of coolant into the mainstream gas flow.

SUMMARY OF THE INVENTION

In accordance with an aspect of the invention, a gas turbine engine hollow turbine airfoil is provided comprising an outer wall surrounding a hollow interior. The outer wall extends radially outwardly in a spanwise direction from an airfoil platform to an airfoil tip. The outer wall additionally has chordwise spaced apart leading and trailing edges, and widthwise spaced apart pressure and suction sidewalls extending chordwise between the leading edge and the trailing edge. A trailing edge rib extends from the trailing edge toward the leading edge, the trailing edge rib forming a solid member between the pressure and suction sidewalls. A cooling fluid channel extends in the spanwise direction through the airfoil adjacent to the trailing edge rib. A plurality of fluid chambers are formed in the trailing edge rib and extend chordwise between the cooling fluid channel and the trailing edge. A plurality of film cooling holes extend from the fluid chambers to the pressure and suction sidewalls, and a plurality of trailing edge discharge holes extend from the fluid chambers to the trailing edge. A metering hole is associated with each of the fluid chambers, each of the metering holes defining a flow restriction connecting the cooling fluid channel to a respective fluid chamber.

In accordance with another aspect of the invention, a gas turbine engine hollow turbine airfoil is provided comprising an outer wall surrounding a hollow interior. The outer wall extends radially outwardly in a spanwise direction from an airfoil platform to an airfoil tip. The outer wall additionally has chordwise spaced apart leading and trailing edges, and widthwise spaced apart pressure and suction sidewalls extending chordwise between the leading edge and the trailing edge. A trailing edge rib extends from the trailing edge toward the leading edge, the trailing edge rib forming a solid member between the pressure and suction sidewalls. A cooling fluid channel extends in the spanwise direction through the airfoil adjacent to the trailing edge rib. A first set of fluid chambers defining a plurality of pressure side fluid chambers are formed in the trailing edge rib and extend chordwise between the cooling fluid channel and the trailing edge adjacent to the pressure sidewall, and a second set of fluid chambers defining a plurality of suction side fluid chambers are formed in the trailing edge rib and extend chordwise between the cooling fluid channel and the trailing edge adjacent to the suction sidewall. A plurality of film cooling holes extend from the pressure side fluid chambers to the pressure sidewall, and a plurality of film cooling holes extend from the suction side fluid chambers to the suction sidewall. A trailing edge discharge hole extends from each of the fluid chambers to the trailing edge. A metering hole is associated with each of the fluid chambers, each of the metering holes defining a flow restriction connecting the cooling fluid channel to a respective fluid chamber.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
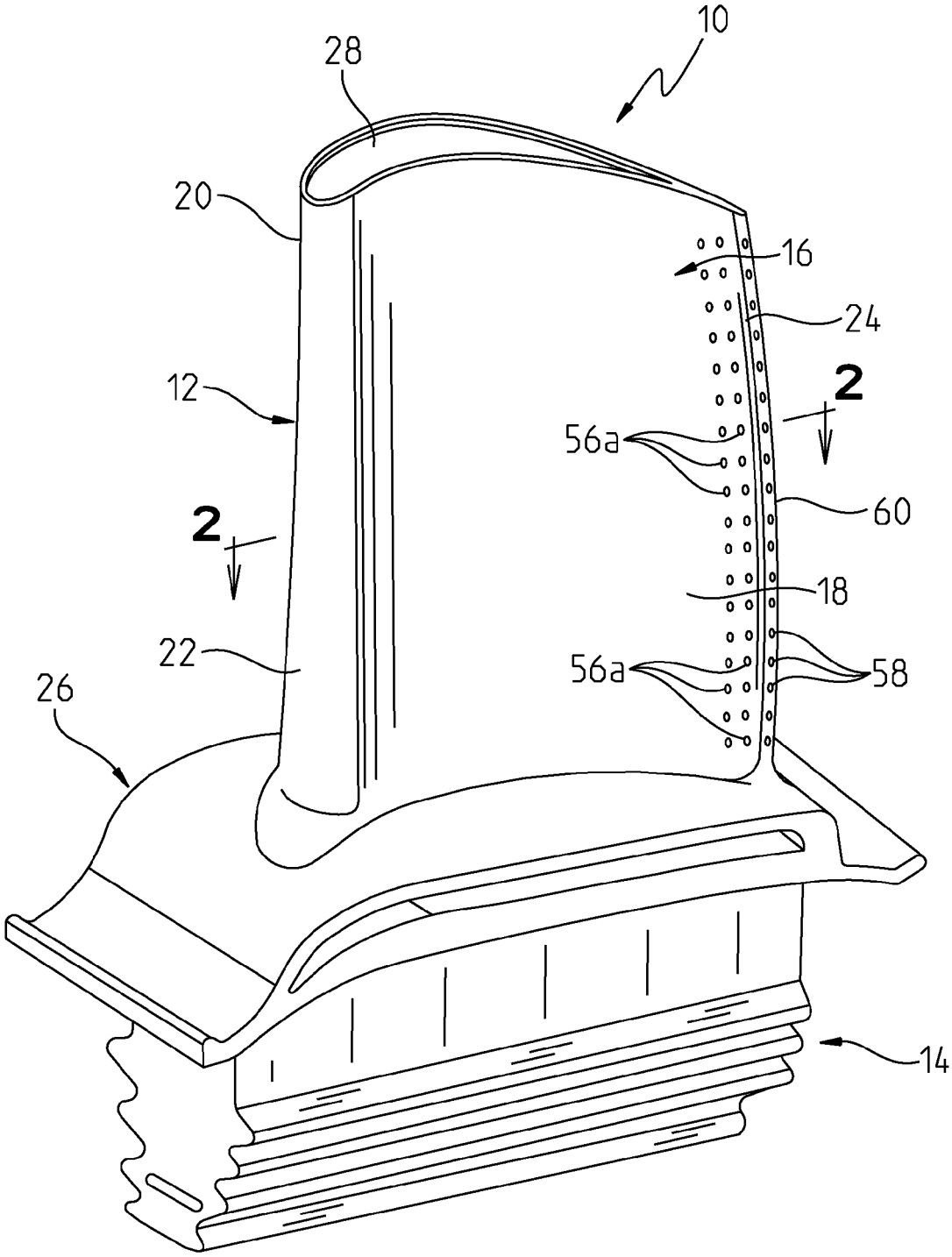
FIG. 1 is a perspective view of a turbine blade including an airfoil incorporating the present invention.
Figure 2:
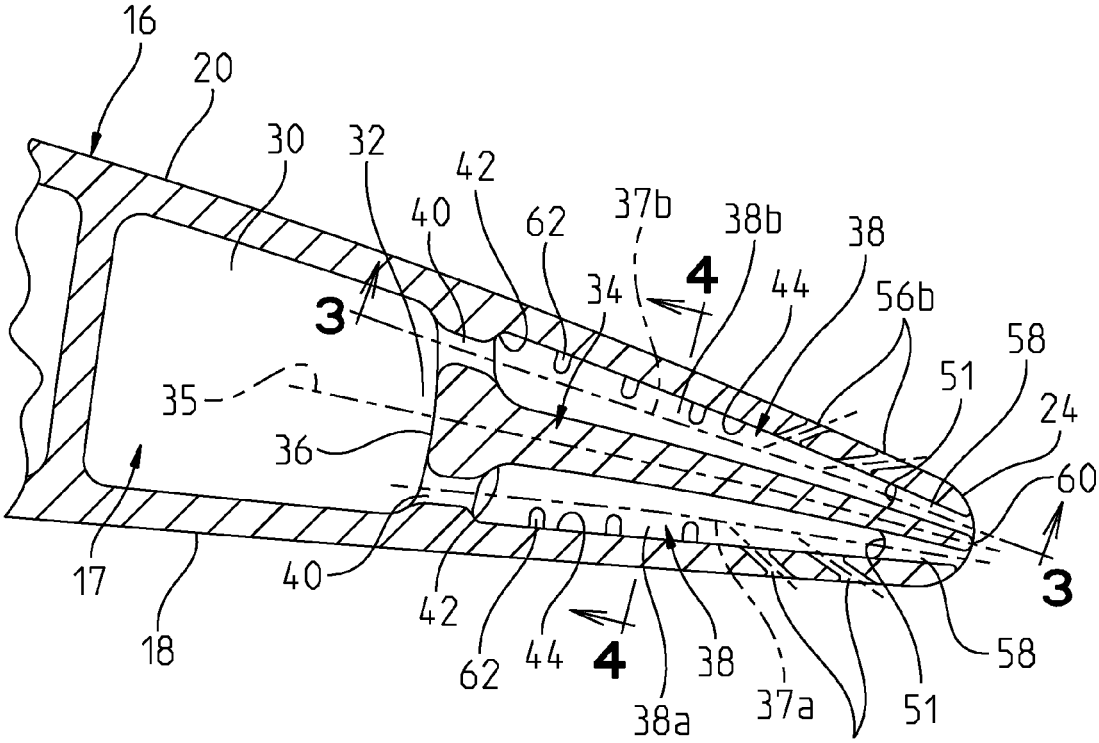
FIG. 2 is a cross-sectional view of the airfoil of FIG. 1 taken along line 2-2 and showing a pressure side fluid chamber and a suction side fluid chamber in plan view.

Referring to FIG. 1, an exemplary turbine blade 10 for a gas turbine engine is illustrated. The blade 10 includes an airfoil 12 and a root 14 which is used to conventionally secure the blade 10 to a rotor disk of the engine for supporting the blade 10 in the working medium flow path of the turbine where working medium gases exert motive forces on the surfaces thereof. The airfoil 12 has an outer wall 16 surrounding a hollow interior 17 (FIG. 2). The airfoil outer wall 16 comprises a generally concave pressure sidewall 18 and a generally convex suction sidewall 20 which are spaced apart in a widthwise direction to define the hollow interior 17 therebetween. The pressure and suction sidewalls 18, 20 extend between and are joined together at an upstream leading edge 22 and a downstream trailing edge 24. The leading and trailing edges 22, 24 are spaced axially or chordally from each other. The airfoil 12 extends radially along a longitudinal or radial direction of the blade 10, defined by a span of the airfoil 12, from a radially inner airfoil platform 26 to a radially outer blade tip surface 28.

As seen in FIG. 2, at least one cooling fluid channel 30 is defined in the hollow interior 17. The cooling fluid channel 30 extends spanwise through the turbine blade 10 and is in fluid communication with a supply of cooling fluid. The cooling fluid channel 30 passes through the airfoil 12 between the pressure sidewall 18 and the suction sidewall 20 to transfer heat from the surfaces of the airfoil sidewalls 18, to the cooling fluid and to maintain the temperature of the blade 10 below a maximum allowable temperature. The cooling fluid channel 30 may comprise a serpentine flow channel or may comprise a single up pass radial channel for directing a cooling fluid, such as cooling air, through the airfoil 12 and out various orifices or openings in the outer wall 16 of the airfoil 12.

The cooling fluid channel 30 includes a trailing edge end 32 located adjacent to a trailing edge rib 34. The trailing edge rib 34 extends from a trailing edge corner 60 of the trailing edge 24 toward the leading edge 22, and forms a solid member between the pressure sidewall 18 and the suction sidewall 20. The trailing edge rib 34 includes a base wall surface 36 in contact with cooling fluid passing through the hollow interior 17 at the trailing edge end 32 of the cooling fluid channel 30.

Figure 3:
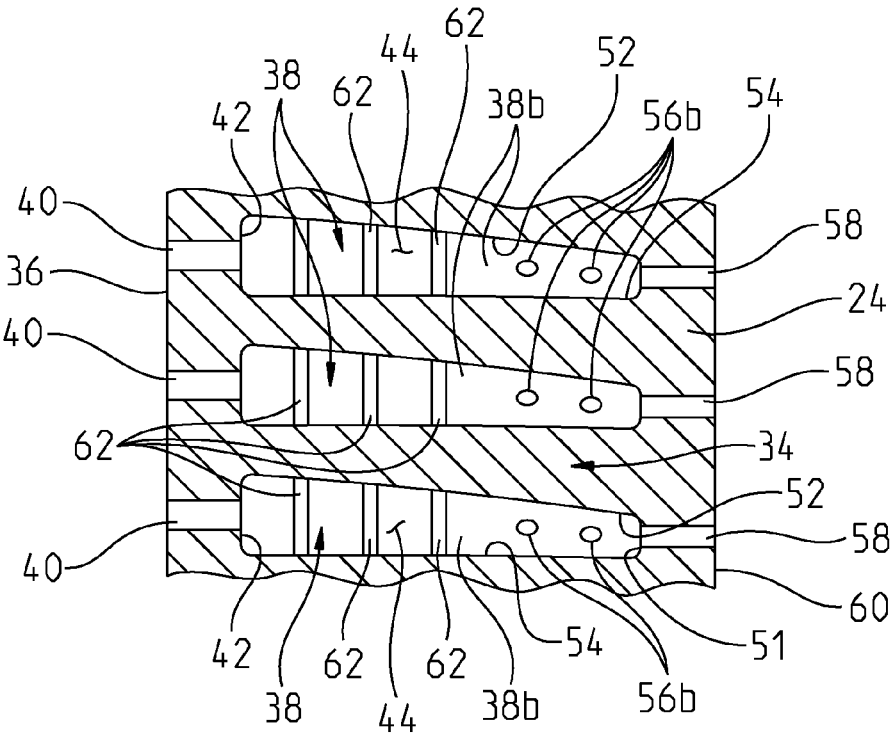
FIG. 3 is a cross-sectional view of the airfoil of FIG. 2 taken along line 3-3 and showing a plurality of suction side fluid chambers in elevation view.

A plurality of small convergent fluid chambers 38 are formed in the trailing edge rib 34 and include an elongated dimension extending in a chordwise direction between the cooling fluid channel 30 and the trailing edge corner 60. Each of the fluid chambers 38 is associated with a metering hole 40 extending chordwise from the base wall surface 36 to a chamber base section 42 of a respective fluid chamber 38. The metering holes 40 provide a fluid connection between each respective fluid chamber 38 and the cooling fluid channel 30. In particular, the cooling fluid channel 30 defines a relatively higher pressure cooling fluid supply area, supplying the cooling fluid to each of the fluid chambers 38, which define lower pressure areas with respect to the cooling fluid channel 30. The metering holes 40 define a flow restriction to restrict or limit cooling fluid flow from the cooling fluid channel 30 to each fluid chamber 38 to a predetermined flow rate as determined by an orifice area, i.e., cross-sectional area, of each metering hole 40. The cross-sectional area of each of the metering holes 40 is preferably smaller than the cross sectional area of a respective fluid chamber 38 at the chamber base section 42 to provide the cooling fluid to each of the fluid chambers 38 at a reduced pressure (FIGS. 2 and 3). While the metering holes 40 may all be formed with the same cross-sectional area, it should be understood that the cross-sectional area of the metering holes 40 may be different for different fluid chambers 38 to provide improved thermal distribution characteristics, i.e., improved convective heat transfer and a more uniform temperature distribution, throughout the area of the trailing edge rib 34 and along the pressure sidewall 18 and the suction sidewall 20 adjacent to the trailing edge 24, as is discussed further below.

Figure 4:
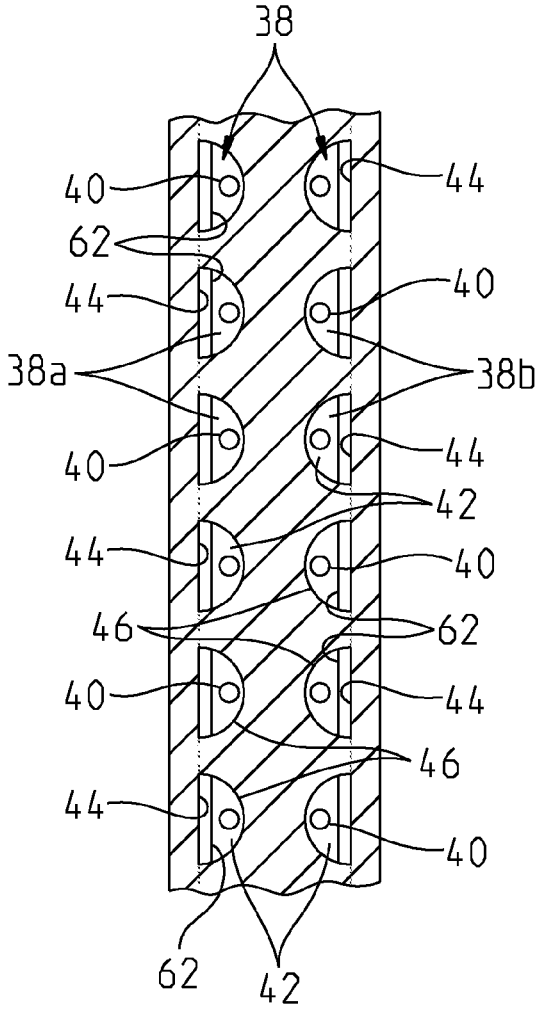
FIG. 4 is a cross-sectional view of the airfoil of FIG. 2 taken along line 4-4 and showing a cross-sectional profile of a portion of the pressure side row and suction side row fluid chambers aligned relative to each other in the spanwise direction.
Figure 4A:
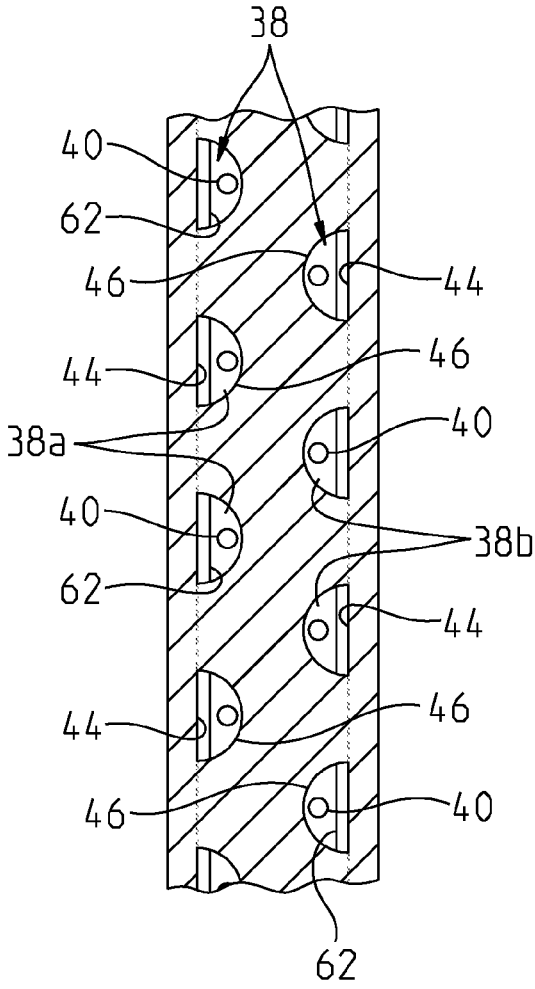
FIG. 4A is a cross-sectional view similar to FIG. 4 showing a cross-sectional profile of a portion of the pressure side row and suction side row fluid chambers staggered relative to each other in the spanwise direction.

Referring to FIGS. 2 and 3, the fluid chambers 38 include a first set of fluid chambers comprising pressure side fluid chambers 38*a* located in a row adjacent to the pressure sidewall 18, and a second set of fluid chambers, different from the first set of fluid chambers, and comprising suction side fluid chambers 38*b* located in a row adjacent to the suction sidewall 20. As seen in FIGS. 4 and 4A, the pressure side fluid chambers 38*a* and suction side fluid chambers 38*b* are each formed with a generally semi-circular cross sectional profile. The pressure and suction side fluid chambers 38*a*, 38*b* are formed with a similar construction and include a flat side 44 and a generally semi-circular curved side 46. The flat sides 44 of the pressure side fluid chambers 38*a* are located adjacent and generally parallel to the pressure sidewall 18, and the semi-circular curved sides 46 of the pressure side fluid chambers 38*a* extend inwardly adjacent to a trailing edge rib centerline 35 (FIG. 2). The flat sides 44 of the suction side fluid chambers 38*b* are located adjacent and generally parallel to the suction sidewall 20, and the semi-circular curved sides 46 of the suction side fluid chambers 38*b* extend inwardly adjacent to the rib centerline 35.

As seen in FIG. 3, illustrating an elevation profile of the fluid chambers 38 with reference to the suction side fluid chambers 38*b*, a spanwise (radial) dimension of the fluid chambers 38 converges in the direction from the chamber base section 42 toward a chamber tip 51 adjacent to the trailing edge corner 60. That is, an upper line 52 line defined by a first, upper intersection of the flat side 44 and the curved semi-circular side 46 converges toward a lower line 54 defined by a second, lower intersection of the flat side 44 and the curved semi-circular side 46, extending in the chordal direction toward the chamber tip 51. Each of the pressure side fluid chambers 38*a* and suction side fluid chambers 38*b* are formed with a similar spanwise converging configuration.

Referring to FIG. 2, each of the pressure side fluid chambers 38*a* and the suction side fluid chambers 38*b* also converge widthwise, i.e., in a direction extending between the pressure and suction sidewalls 18, 20, from the chamber base section 42 toward the chamber tip 51. The radii of the curved semi-circular sides 46 of each of the pressure and suction side fluid chambers 38*a*, 38*b* decreases from the chamber base section 42 toward the chamber tip 51. The decreasing radii of the curved semi-circular sides 46 provides a conical segment configuration in which the curved semi-circular sides 46 converge toward the respective flat sides 44 of the pressure and suction side fluid chambers 38*a*, 38*b*.

As seen in FIG. 4, the fluid chambers 38 may be arranged in the trailing edge rib 34 in an inline array along the airfoil 12 in the spanwise direction. In particular, the row of pressure side fluid chambers 38*a* are located at spanwise locations that are aligned with spanwise locations of the row of suction side fluid chambers 38*b*, such that the individual fluid chambers 38 of the rows of fluid chambers 38*a*, 38*b* are located in side-by-side relation to each other.

Alternatively, as seen in FIG. 4A, the fluid chambers 38 may be arranged in the trailing edge rib 34 in a staggered array along the airfoil 12 in the spanwise direction. In particular, the row of pressure side fluid chambers 38*a* are located at spanwise locations that are offset relative to the spanwise locations of the suction side fluid chambers 38*b*. In both the configurations illustrated in FIGS. 4 and 4A, the pressure side fluid chambers 38*a* are located in a spanwise row with centerlines 37*a* of the pressure side fluid chambers 38*a* (extending centrally through the fluid chambers 38*a*) offset from the rib centerline 35 toward the pressure sidewall 18, and the suction side fluid chambers 38*b* are located in a spanwise row with centerlines 37*b* of the suction side fluid chambers 38*b* (extending centrally through the fluid chambers 38*b*) offset from the centerline 35 of the trailing edge rib 34 toward the suction sidewall 20.

Referring to FIG. 2, a plurality of pressure side film cooling holes 56*a* extend from each of the pressure side fluid chambers 38*a* to the outer surface of the pressure sidewall 18, and a plurality of suction side film cooling holes 56*b* extend from each of the suction side fluid chambers 38*b* to the outer surface of the suction sidewall 38*b*. Although two film cooling holes 56*a*, 56*b* are illustrated for each of the respective fluid chambers 38*a*, 38*b*, a fewer or greater number of film cooling holes 56*a*, 56*b* may be provided. Preferably, the pressure side fluid chambers 38*a* provide cooling fluid only to the pressure side film cooling holes 56*a* for cooling the pressure sidewall 18, and the suction side fluid chambers 38*b* provide cooling fluid only to the suction side film cooling holes 56*b* for cooling the suction sidewall 20.

Cooling fluid flowing through the pressure and suction side fluid chambers 38*a*, 38*b* is discharged out respective ones of the film cooling holes 56*a*, 56*b* to form a film of cooling fluid for performance of transpiration cooling along the pressure and suction sidewalls, 18, 20 at the trailing edge 24. In addition, a trailing edge discharge hole 58 is associated with each of the fluid chambers 38, as seen in FIGS. 2 and 3. Each trailing edge discharge hole 58 comprises a through hole extending from the chamber tip of a respective fluid chamber 38 through the trailing edge corner 60 to discharge cooling fluid that has passed through the fluid chamber 38 out of the airfoil 12.

As mentioned above, the size of the metering holes 40 for the fluid chambers 38 is selected to provide a desired flow into the fluid chambers 38. In particular, it is desirable to provide a cooling fluid flow in the pressure and suction side fluid chambers 38*a*, 38*b* at a pressure that results in the cooling fluid flowing through the respective film cooling holes 56*a*, 56*b* at a predetermined controlled rate for forming a transpiration cooling film along the pressure sidewall 18 and suction sidewall 20 at the trailing edge 24. The pressure at which cooling fluid is provided to the cooling fluid channel 30 is substantially high enough that the cooling fluid could be ejected out of the film cooling holes 56*a*, 56*b*, away from the film cooling area of pressure and suction sidewalls 18, 20 unless the pressure is metered down to slow the momentum of the outwardly flowing cooling fluid. The metered cooling fluid flow to each of the fluid chambers 38 reduces the pressure differential across the film cooling holes 56*a*, 56*b*, i.e., between the pressure in the fluid chambers 38 and the external gas pressure around the outer wall 16, and thus reduces the momentum of the exiting cooling fluid. Further, it should be understood that the pressure applied by the hot gases along the pressure and suction sidewalls 18, 20 varies in the spanwise direction, where the spanwise pressure variation is typically not linear and may, for example, be a parabolic variation. In addition, the gas pressure at the pressure sidewall 18 will be different from the gas pressure at the suction sidewall 20. Hence, in order to provide the same (or substantially the same) pressure differential to the film cooling holes 56*a*, 56*b* of the fluid chambers 38*a*, 38*b*, the pressure of the cooling fluid required at different locations of the rows of fluid chambers 38*a*, 38*b* will vary based on the location and associated external gas pressure applied to the outer wall 16 at the particular location. Accordingly, the size of the metering hole 40 for each of the fluid chambers 38 is selected with reference to the external gas pressure associated with the location of each respective fluid chamber 38. Alternatively, or in addition, the size of the film cooling holes 56*a*, 56*b* and/or the size of the discharge holes 58 may be selected to control the cooling fluid pressure within the fluid chambers 38 and to provide a desired differential pressure across the film cooling holes 56*a*, 56*b*.

As the cooling fluid flows into the fluid chambers 38 through the respective metering holes 40 and out of the film cooling holes 56*a*, 56*b*, the loss of cooling fluid from the fluid chambers 38*a*, 38*b* through the respective film cooling holes 56*a*, 56*b* is compensated by the converging configuration of the fluid chambers 38*a*, 38*b*, where the progressively restricted area maintains the momentum of the cooling fluid as it travels to the discharge holes 58. In addition, the converging configuration of the fluid chambers 38 provides a varying level of convective heat transfer within the fluid chambers 38 generally corresponding to the varying cooling requirements within the area of the trailing edge 24 in the chordwise direction. At the entrance region of the fluid chambers 38, adjacent to the chamber base section 42 where the airfoil width (pressure sidewall-to-suction sidewall dimension) is greater, the heat transfer requirement for cooling this area of the trailing edge 24 is lower than the chordally opposite end of the chamber 38 at the chamber tip 51 adjacent to the trailing edge corner 60. The converging configuration of the chambers 38, as provided by the decreasing radius of the semi-circular curved sides 46 and the spanwise decreasing dimension of the flat sides 44, facilitates an increase in convective cooling from the interior walls of the cooling chambers 38 to the cooling fluid by maintaining or increasing the momentum of the cooling fluid as it approaches the discharge holes 58, even with the cooling fluid being bled off through the film cooling holes 56*a*, 56*b*. Thus, the flow of cooling fluid across the interior surfaces of the chambers 38 may be increased in the chordal direction to accommodate increasing cooling requirements in the area of the trailing edge 24 of the airfoil 12. Cooling fluid that has not been used for transpiration cooling through the film cooling holes 56*a*, 56*b*, and that has passed through the fluid chambers 38 to convectively cool the trailing edge rib 34, exits out of the fluid chambers 38 through the discharge holes 58.

Each of the fluid chambers 38 may additionally include trip strips 62 extending from the flat side 44 of the fluid chambers 38. The trip strips 62 further facilitate transfer of heat to the cooling fluid passing through the fluid chambers 38.

From the above, it can be seen that the provision of the fluid chambers 38 in the spanwise internal trailing edge rib 34 enhances the trailing edge internal convection capability by providing increased heat transfer surface area at the chamber sides 44, 46 and by maintaining or increasing the flow rate through the length of the fluid chambers 38, resulting in a reduction of the temperature of the airfoil trailing edge 24. In addition, the metered flow of fluid into the fluid chambers 38 provides a controlled pressure differential at the respective film cooling holes 56*a*, 56*b*, reducing the cooling air exit momentum and minimizing coolant penetration into the hot gas flow surrounding the airfoil 12. Hence, the build-up of a coolant sub-boundary layer directly adjacent to the airfoil outer wall 16 is improved, providing improved coolant film coverage in the chordwise and spanwise directions at the airfoil trailing edge 24.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine hollow turbine airfoil comprising:

an outer wall surrounding a hollow interior;

said outer wall extending radially outwardly in a spanwise direction from an airfoil platform to an airfoil tip and having chordwise spaced apart leading and trailing edges, and widthwise spaced apart pressure and suction sidewalls extending chordwise between said leading edge and said trailing edge;

a trailing edge rib extending from said trailing edge toward said leading edge, said trailing edge rib forming a solid member between said pressure and suction sidewalls;

a cooling fluid channel extending in the spanwise direction through said airfoil adjacent to said trailing edge rib;

a plurality of fluid chambers formed in said trailing edge rib and extending chordwise between said cooling fluid channel and said trailing edge;

a plurality of film cooling holes extending from said fluid chambers to said pressure and suction sidewalls;

a plurality of trailing edge discharge holes extending from said fluid chambers to said trailing edge; and a metering hole associated with each of said fluid chambers, each said metering hole defining a flow restriction connecting said cooling fluid channel to a respective fluid chamber.

2. The airfoil as set out in claim 1, wherein said plurality of fluid chambers are arranged in two spanwise rows comprising first ones of said fluid chambers defining a pressure side row located adjacent to said pressure sidewall, and second ones of said fluid chambers different from said first ones of said fluid chambers and defining a suction side row located adjacent to said suction sidewall.

3. The airfoil as set out in claim 2, wherein said trailing edge rib defines a rib centerline extending in a chordal direction between said pressure sidewall and said suction sidewall, and said pressure side row of said fluid chambers each defining a centerline offset from the rib centerline toward said pressure sidewall and said suction side row of said fluid chambers each defining a centerline offset from the rib centerline toward said suction sidewall.

4. The airfoil as set out in claim 2, wherein said fluid chambers of said pressure side row are located at spanwise locations that are aligned with spanwise locations of said fluid chambers of said suction side row.

5. The airfoil as set out in claim 2, wherein said fluid chambers of said pressure side row are located at spanwise locations that are offset relative to spanwise locations of said fluid chambers of said suction side row.

6. The airfoil as set out in claim 1, wherein each of said fluid chambers are formed as a conical segment having a larger chamber base section adjacent said cooling fluid channel and a smaller chamber tip section adjacent said trailing edge.

7. The airfoil as set out in claim 6, wherein each said fluid chamber includes a flat side located adjacent and substantially parallel to one of said pressure sidewall or said suction sidewall.

8. The airfoil as set out in claim 6, wherein each of said metering holes has a cross-sectional area that is smaller than a cross-sectional area of a respective chamber base section.

9. The airfoil as set out in claim 1, wherein said metering holes comprise different cross-sectional areas for different respective ones of said fluid compartments.

10. The airfoil as set out in claim 9, wherein said different cross-sectional areas of said metering holes are sized to correspond to variations in gas pressure profiles spanwise along said pressure sidewall and said suction sidewall adjacent to said trailing edge.

11. The airfoil as set out in claim 1, wherein each of said fluid chambers comprises a semi-circular cross-sectional profile.

12. A gas turbine engine hollow turbine airfoil comprising:

an outer wall surrounding a hollow interior;

said outer wall extending radially outwardly in a spanwise direction from an airfoil platform to an airfoil tip and having chordwise spaced apart leading and trailing edges, and widthwise spaced apart pressure and suction sidewalls extending chordwise between said leading edge and said trailing edge;

a trailing edge rib extending from said trailing edge toward said leading edge, said trailing edge rib forming a solid member between said pressure and suction sidewalls;

a cooling fluid channel extending in the spanwise direction through said airfoil adjacent to said trailing edge rib;

a first set of fluid chambers defining a plurality of pressure side fluid chambers formed in said trailing edge rib and extending chordwise between said cooling fluid channel and said trailing edge adjacent to said pressure sidewall;

a second set of fluid chambers defining a plurality of suction side fluid chambers formed in said trailing edge rib and extending chordwise between said cooling fluid channel and said trailing edge adjacent to said suction sidewall;

a plurality of film cooling holes extending from said pressure side fluid chambers to said pressure sidewall, and a plurality of film cooling holes extending from said suction side fluid chambers to said suction sidewall;

a trailing edge discharge hole extending from each of said fluid chambers to said trailing edge; and a metering hole associated with each of said fluid chambers, each said metering hole defining a flow restriction connecting said cooling fluid channel to a respective fluid chamber.

13. The airfoil as set out in claim 12, wherein said pressure fluid chambers do not include film cooling holes extending to said suction sidewall, and said suction side fluid chambers do not include film cooling holes extending to said pressure sidewall.

14. The airfoil as set out in claim 12, wherein each of said fluid chambers are formed as a converging section having a decreasing cross-sectional area in a chordwise direction from said cooling fluid channel toward said trailing edge.

15. The airfoil as set out in claim 14, wherein said converging section comprises a conical segment having a larger chamber base section adjacent said cooling fluid channel and a smaller chamber tip section adjacent said trailing edge.

16. The airfoil as set out in claim 15, wherein each said pressure side fluid chamber includes a flat side located adjacent said pressure sidewall and each said suction side fluid chamber includes a flat side located adjacent said suction sidewall.

17. The airfoil as set out in claim 16, wherein each of said fluid chambers comprises a semi-circular cross-sectional profile.

18. The airfoil as set out in claim 14, wherein each of said metering holes has a cross-sectional area smaller than the cross-sectional area of a respective fluid chamber at an end adjacent to the cooling fluid channel.

19. The airfoil as set out in claim 12, wherein said metering holes comprise different cross-sectional areas for different respective ones of said fluid chambers.

20. The airfoil as set out in claim 19, wherein said different cross-sectional areas of said metering holes are sized to correspond to variations in gas pressure profiles spanwise along said pressure sidewall and said suction sidewall adjacent to said trailing edge.

* * * * *